United States Patent [19]

Farnham

[11] 4,002,555

[45] Jan. 11, 1977

[54] HYDROCARBON REFORMING PROCESS

[75] Inventor: Robert A. Farnham, San Rafael, Calif.

[73] Assignee: Chevron Research Company, San Francisco, Calif.

[22] Filed: Jan. 7, 1976

[21] Appl. No.: 647,035

[52] U.S. Cl. ..... 208/80; 208/79; 208/139

[51] Int. Cl.[2] ..... C10G 35/08; C10G 39/00

[58] Field of Search ..... 208/79, 138, 80, 139

[56] References Cited

UNITED STATES PATENTS

| | | | |
|---|---|---|---|
| 2,765,264 | 10/1956 | Pasik | 208/65 |
| 2,767,124 | 10/1956 | Myers | 208/64 |
| 2,867,576 | 1/1959 | Honeycutt | 208/65 |
| 3,011,967 | 12/1961 | Schmitkons et al. | 208/139 |
| 3,091,584 | 5/1963 | Singer | 208/65 |
| 3,415,737 | 12/1968 | Kluksdahl | 208/139 |
| 3,705,094 | 12/1972 | Keith et al. | 208/65 |
| 3,705,095 | 12/1972 | Dalson et al. | 208/65 |
| 3,801,494 | 4/1974 | Moore et al. | 208/79 |
| 3,928,174 | 12/1975 | Bonacci et al. | 208/80 |

*Primary Examiner*—Herbert Levine
*Assistant Examiner*—G. E. Schmitkons
*Attorney, Agent, or Firm*—G. F. Magdeburger; R. H. Davies; W. D. Reese

[57] ABSTRACT

A process is disclosed for reforming two hydrocarbon feedstocks by contacting one feedstock and hydrogen with a reforming catalyst in a first reforming zone at reforming conditions including a relatively high reforming pressure; separating a hydrogen-rich gas and first hydrocarbon product from the effluent from the first zone at a pressure below the first reforming pressure; recycling a first portion of the hydrogen-rich gas to provide hydrogen for the first reforming zone; contacting the other feedstock and a second portion of the hydrogen-rich gas with a second reforming catalyst in a second reforming zone at reforming conditions including a pressure lower than the first reforming pressure, with all of the hydrogen gas introduced into the second reforming zone being obtained solely from the first reforming zone effluent; and recovering a second hydrocarbon product from the effluent from the second reforming zone. The process eliminates a hydrogen recycle compressor for the second reforming zone and operates without compressing hydrogen passed from the first reforming zone to the second reforming zone.

9 Claims, 1 Drawing Figure

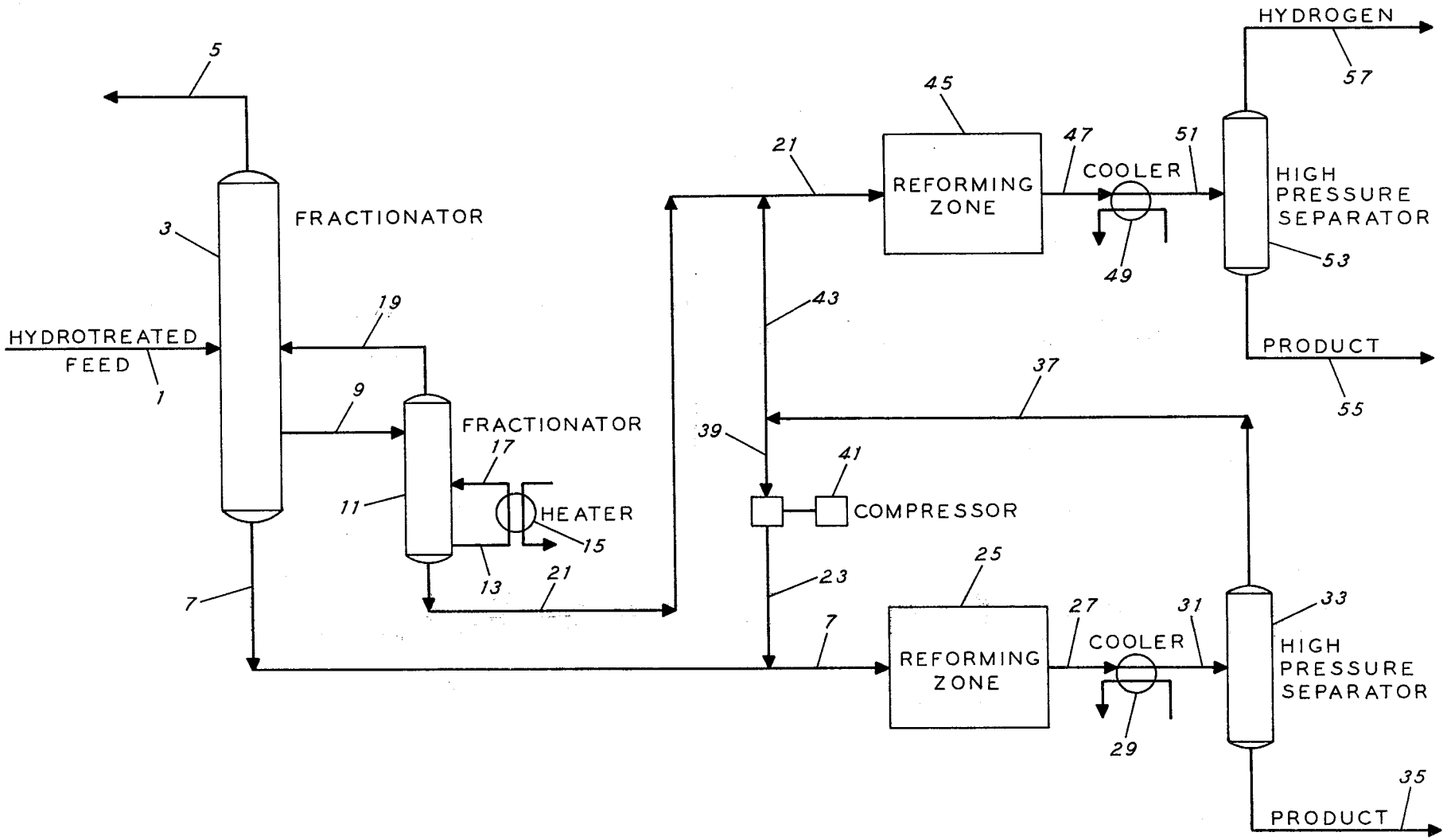
HYDROGEN
57
HIGH PRESSURE SEPARATOR
53
PRODUCT
55
HIGH PRESSURE SEPARATOR
33
PRODUCT
35
51
COOLER
49
31
COOLER
29
47
27
37
REFORMING ZONE
45
COMPRESSOR
41
REFORMING ZONE
25
21
43
39
23
7
FRACTIONATOR
17
HEATER
15
21
13
FRACTIONATOR
19
9
11
5
3
7
HYDROTREATED FEED
1

HYDROCARBON REFORMING PROCESS

BACKGROUND OF THE INVENTION

This invention relates to a process for reforming hydrocarbons, and relates particularly to a process for combining high-pressure and low-pressure reforming of naphthas, which eliminates use of a hydrogen recycle compressor in the low-pressure reforming operation.

Reforming is well known as a method for upgrading petroleum gasoline fractions. The art has suggested splitting a relatively wide-boiling-range petroleum fraction into a lighter cut and a heavier cut and separately reforming the two cuts using optimum operating conditions to process each one. Such a process is described, for example, in U.S. Pat. No. 2,767,124, which suggests fractionating a full-boiling-range (100°–430° F) fraction into a lighter (100°–230° F) fraction and a heavier (230°–430° F) fraction, reforming the heavier fraction at a pressure of 5–50 atmospheres and reforming the lighter fraction at a pressure of 1–4 atmospheres.

It is generally necessary to mix hydrogen with a hydrocarbon feed before charging the feed to a reforming reactor. The presence of hydrogen in the reforming reactor at a relatively high hydrogen-hydrocarbon mol ratio has been found to help prevent fouling of the reforming catalyst. Since hydrogen is produced in the reforming reactor in a conventional reforming process, hydrogen in the feed to the reactor is provided by separating the reactor effluent into a liquid product and a hydrogen-containing gas and recycling hydrogen recovered from the reactor effluent. Recycle of hydrogen has required the use of a recycle gas compressor, attendant capital expense and costly operating and utilities expenses being necessitated by use of the compressor. The process of the present invention is directed, in part, to eliminating the necessity for such a recycle gas compressor in a combination reforming process.

The art has suggested elimination of a recycle gas compressor from a reforming process by reforming a single hydrocarbon feedstock in two serial stages, with hydrogen for the second stage being supplied from hydrogen produced in the first stage. An operating scheme of this type is shown in U.S. Pat. No. 2,765,264, which describes a process for reforming a gasoline fraction by: (1) an "aromatization" reaction step, with hydrogen produced being separated from the aromatized hydrocarbon, after which the hydrocarbon is split into several portions; and (2) a "reforming" step in which hydrogen from the previous aromatization step supplies the hydrogen requirement for reforming one of the portions of the aromatized stock. Such a two-stage reforming operation has not found general acceptance in commercial reforming. Thus, compression and recycle of hydrogen remains a serious economic drawback in many reforming operations.

It is known to reform a relatively narrow boiling-range naphtha to provide reformate with high concentrations of benzene and toluene. These aromatics are then separated from the reformate for petrochemical use. It is desirable to reform such so-called benzene-toluene feeds separately from higher boiling hydrocarbons to allow efficient separation of the desired aromatics from the reformate in the absence of unwanted, higher boiling aromatics. Separate reforming systems have thus been used to reform the benzene-toluene feed and the higher boiling hydrocarbons. This has necessitated the use of two complete reforming systems having separate hydrogen recycle arrangements including separate recycle compressors.

Recent catalyst developments in the reforming art have allowed reforming to be undertaken at relatively low hydrogen pressures, e.g., 100–200 psig, with reasonable reforming catalyst stability. Some reforming units can operate at relatively low hydrogen pressures by continuous regeneration of the catalyst, even though it becomes rapidly fouled at a low hydrogen pressure. Likewise, swing reactor process schemes have been used to regenerate reforming catalysts at short intervals when low-pressure reforming processes have been undertaken.

SUMMARY OF THE INVENTION

An object of the present invention is to provide a hydrocarbon reforming process which includes a combination of two reforming systems in which hydrogen from one system is passed to the second to eliminate a hydrogen gas recycle compressor in the second system.

In an embodiment, the invention relates to a process for reforming a first hydrocarbon feedstock and a second hydrocarbon feedstock by the steps of: contacting the first feedstock and hydrogen with a reforming catalyst in a first reforming zone at reforming conditions including a first reforming pressure; separating a hydrogen-rich gas and a first liquid hydrocarbon product from the effluent from the first reforming zone at a separation pressure below the first reforming pressure; recycling a first portion of the hydrogen-rich gas to provide at least a portion of the hydrogen gas passed into the first reforming zone; contacting the second feedstock and a second portion of the hydrogen-rich gas with a reforming catalyst in a second reforming zone at reforming conditions including a second reforming pressure lower than the first reforming pressure, hydrogen introduced into the second reforming zone being obtained solely from the hydrogen-rich gas; and recovering a second hydrocarbon product from the effluent from the second reforming zone. In a preferred embodiment of the process set forth above, the first and second feedstocks are formed by separating a wide-boiling-range hydrocarbon feed into a higher-boiling fraction and a lower-boiling fraction; reforming the higher-boiling fraction in the first reforming zone at a reforming pressure above 175 psig, and reforming the lower-boiling fraction in the second reforming zone at a reforming pressure of about 75 psig to about 150 psig.

By passing excess hydrogen produced in the first reforming system directly into the second reforming system without compressing it, in accordance with the present invention, the sole supply of hydrogen used in the second reforming system is provided by the lower pressure hydrogen separated from the product of the first reforming system. The recycle compressor in the second system is accordingly eliminated.

DESCRIPTION OF THE DRAWING

The attached drawing is a schematic representation of a preferred embodiment of the invention.

Referring to the drawing, a hydrotreated wide-boiling-range gasoline fraction is passed into the system through a conduit 1 and into a fractionator 3. In the fractionator 3 light gases are removed from the feed and are withdrawn from the system through an overhead conduit 5. A bottoms stream of a higher-boiling fraction of the fractionator charge is removed through a conduit 7. A sidecut stream of a lower-boiling fraction of the charge is removed from the fractionator 3 through a conduit 9 and is passed into a second fractionator 11. In the fractionator 11, the hydrocarbons charged thereto are reboiled by removing a sidecut of hydrocarbons through a conduit 13, heating the sidecut in a heater 15 and reintroducing the heated hydrocarbons into the fractionator 11 via the conduit 17. Light ends are removed overhead from the fractionator 11 to a conduit 19 and are reintroduced into the fractionator 3. A bottoms stream containing the lower-boiling hydrocarbon fraction is removed from the fractionator 11 through a conduit 21.

A stream of hydrogen from a source described hereinafter is passed from a conduit 23 into the conduit 7 and is mixed with the higher-boiling hydrocarbon stream from the fractionator 3. This hydrocarbon-hydrogen mixture is passed through the conduit 7 into a reforming zone 25 and contacted with a reforming catalyst at reforming conditions. The reaction products are removed from the reforming zone 25 through a conduit 27, and are cooled and partially condensed in a cooler 29. They are then passed through a conduit 31 into a high-pressure separator vessel 33. In the high-pressure separator 33, a hydrogen-containing gas phase separates from a liquid hydrocarbon product phase. A first liquid stream of hydrocarbon product is removed from the separator 33 through a conduit 35 and is withdrawn from the reforming system. This product stream may, if desired, be passed from the conduit 35 to further conventional separation and purification operations, such as a low-pressure separator vessel (not shown). The hydrogen-containing gas in the high-pressure separator 33 is removed through a conduit 37 and is split into two portions, the first of which is passed into a conduit 39. This hydrogen-containing gas stream supplies hydrogen to the reforming zone 25. This portion of hydrogen-containing gas is passed through the conduit 39 into a compressor 41, wherein the gas is compressed to the pressure desired for reforming operations in the reforming zone 25. The resulting compressed hydrogen gas is then passed through the conduit 23 into the conduit 7 for use in the reforming zone 25. The second portion of hydrogen-containing gas from the conduit 37 is passed into a conduit 43 and then into the conduit 21 where it is mixed with the lighter hydrocarbon fraction. This hydrogen-hydrocarbon mixture is passed from the conduit 21 into a reforming zone 45 and is contacted therein with a reforming catalyst at reforming conditions. The hydrogen-containing gas passed into the conduit 21 from the conduit 43 is the sole source of hydrogen gas introduced into the reforming zone 45. This hydrogen gas is passed from the high-pressure separator 33 through the conduits 37, 43 and 21 into the reforming zone 45 without a compression step, in accordance with the present invention. The reaction products of the reforming operation in the reforming zone 45 are withdrawn and passed through a conduit 47 into a cooler 49, in which the effluent from the reforming zone 45 is cooled and partially condensed. The cooled materials are then passed through a conduit 51 into a high-pressure separator vessel 53, wherein a hydrogen-rich gaseous phase and a hydrocarbon product-rich liquid phase are formed. A stream of liquid hydrocarbon product is removed from the separator vessel 53 through a conduit 55 and withdrawn from the system. The product stream removed through the conduit 55 may, if desired, be passed to further conventional separation and purification operations, such as treatment in a low-pressure separation vessel (not shown). A low-pressure hydrogen-containing gas is withdrawn from the high-pressure separator 53 through a conduit 57 and is removed from the system. The gas withdrawn from the system in the conduit 57 may be passed to a conventional refinery operation, such as a gas collection and concentration system (not shown), if desired.

DETAILED DESCRIPTION OF THE INVENTION

The process of the present invention is employed for separately reforming two hydrocarbon feedstocks and is accordingly to be distinguished from schemes wherein plural reforming steps are performed in series operation on one hydrocarbon feedstock. In the present process, hydrocarbon product effluent obtained from either one of the two reforming zones employed in the process cannot suitably be used as a feedstock to the other reforming zone. The feedstocks used in the present process may suitably be the same gasoline-boiling-range (e.g., 100°–430° F) refinery streams as are conventionally processed in commercial gasoline-type reforming operations. In a preferred embodiment, one of the feedstocks used in the process is a relatively high-boiling hydrocarbon fraction, with an initial boiling point (IBP) in the 200°–275° F range and an end boiling point (EBP) in the 350°–430° F range; the other feedstock is, in this preferred case, a relatively low-boiling hydrocarbon fraction with an IBP in the 75°–175° F range and an EBP in the 200°–275° F range. Such light and heavy feedstocks can conveniently be provided by separating a conventional, relatively full-boiling-range hydrocarbon stream, e.g., by fractionating the stream in a manner well known to those skilled in the art. For example, a full-boiling-range feedstock with an IBP of about 100° F and an EBP of about 430° F may be fractionated to form a lower-boiling fraction in roughly the 100°–250° F boiling range and a higher-boiling fraction in roughly the 250°–430° F boiling range. The lower-boiling feed stream is preferably processed in one reforming zone using hydrogen derived solely from processing of the higher-boiling fraction in another reforming zone in accordance with the present process, as more fully described below.

The reforming catalysts which are used in both the reforming systems in the process of this invention may suitably be those reforming catalysts which contain a platinum group component or compound thereof associated with a porous solid carrier. Of the platinum group metals, platinum, palladium and iridium are preferred, and platinum is particularly preferred. The platinum group component is present in the catalyst in a concentration of about 0.01 to about 3 weight percent, preferably 0.01 to about 1 weight percent, based on the elemental metal. The porous solid carrier component of the catalyst is preferably an inorganic oxide, particularly one having a surface area of about 50 to 750 $m^2/g$. A particularly preferred surface area range is 150–750 $m^2/g$. The carrier can be a natural or synthetic inorganic oxide or mixture of inorganic oxides. Such materials as silica, alumina, silica-alumina, zirconia, magnesia, and crystalline aluminosilicate zeolites, or mixtures thereof, are suitable for use. It is particularly preferred that an alumina component be present in the carrier, either alone, or admixed with one or more other inorganic oxides. A suitable alumina carrier may be prepared in a number of ways known to those skilled in the art as, for example, by reaction of metallic alumina with hydrofluoric acid, acetic acid, etc., to form a hydrosol, which is then gelled with a suitable precipitating agent, such as ammonium hydroxide, followed by drying and calcining.

Other components in addition to the platinum group metal or metals, such as promoter metals, may be present in the catalysts. It is particularly preferred that rhenium be employed in the catalyst, for example, in an amount of about 0.01 to about 5 weight percent or more, preferably about 0.01 to about 2 weight percent, based on the elemental metal. Since rhenium significantly improves the yield stability of a platinum-containing catalyst, a catalyst containing both platinum and rhenium is particularly preferred for use in both the reforming systems in the present process. A suitable platinum-rhenium catalyst is described in detail in U.S. Pat. No. 3,415,737. In addition to at least one platinum group metal and rhenium, the catalyst preferably contains a halide component, preferred halides being fluoride and chloride, particularly chloride. The catalyst perferably contains about 0.1 to about 3 weight percent total halide. A halide component can be incorporated into the catalyst at any suitable stage of catalyst manufacture, for example, prior to or following the incorporation of the platinum group component, the rhenium component or both. The halide component can also be incorporated into the catalyst at the same time as the platinum group component and/or rhenium component.

Reforming conditions employed in both of the reforming zones in the present process include a temperature of about 600° F to about 1100° F, a pressure of about 25 psig to about 500 psig, a hydrogen-hydrocarbon mol ratio of about 1:1 to 1:10 and a liquid hourly space velocity (LHSV) of about 0.5 to about 5. In a preferred embodiment, wherein a relatively higher-boiling feedstock (e.g., a 220°–420° F cut) is processed in a first reforming zone and a relatively lower-boiling feedstock (e.g., a 100°–220° F cut) is processed in a second reforming zone, the reforming conditions employed in the first reforming zone preferably include a temperature of about 750° to 1050° F, a pressure of about 175 to 300 psig, a hydrogen-hydrocarbon mol ratio of about 3 to about 8, and an LHSV of about 0.75 to about 3, and the reforming conditions employed in the second reforming zone preferably include a temperature of about 750° to 1050° F, a pressure of about 75 to 150 psig, a hydrogen-hydrocarbon mol ratio of about 2 to about 6, and an LHSV of about 0.5 to about 2. The reforming zones may use fixed or moving bed reactor systems of conventional type and may use continuous, semi-continuous or swing bed regeneration type operations, as well as long term, fixed bed type systems.

By including a preferred hydrogen pressure above 175 psig in the first reforming zone and processing the preferred higher-boiling feed therein, while simultaneously employing a preferred hydrogen pressure of 75–150 psig in processing the preferred lower-boiling feedstock in the second reforming zone, the total hydrogen gas requirement for the second reforming zone is supplied from the first reforming zone effluent without compression being necessary, and there is no recycle hydrogen requirement in the second reforming zone, even without continuous or swing reactor regeneration type operations in the second reforming zone. The elimination of the hydrogen recycle requirement in the second zone is particularly advantageous when the feedstock processed in the second reforming zone is a light-type naphtha such as a stock conventionally reformed to provide high yields of benzene and toluene, as for example a 150°–220° F boiling range stock. The present process is particularly effective when the reforming pressure in the first reforming zone is maintained at least 50 psi higher than the reforming pressure in the second reforming zone, in part to compensate for pressure drops occurring in gas transmission.

The effluent from either reforming zone includes hydrogen and a normally liquid hydrocarbon product. The reaction zone effluent is treated in conventional apparatus to separate a hydrogen-rich gas from the hydrocarbon product, as by cooling and partially condensing the effluent and then flash-separating the hydrogen-containing gas from the resulting liquid. The flash-separation procedure may be performed in a conventional high-pressure separator vessel. After separation from the hydrogen-containing gas, the liquid hydrocarbon product may be further treated, as by stabilization in any desired manner to remove light hydrocarbon gases and other impurities. The hydrocarbon products produced in the present process are useful as gasoline blending stocks or as intermediate feedstocks for obtaining such petrochemicals as benzene, toluene, xylenes, etc.

After the effluent from the first reforming zone has been separated into a hydrogen-containing gas stream and a liquid hydrocarbon product stream, the product stream is withdrawn from the process, and the hydrogen-rich gas is split into two portions. One of these portions is preferably recycled to the first reforming zone in a conventional manner, using a recycle compressor, to supply the hydrogen for the reforming operations performed in the first reforming zone. The amount of hydrogen-rich gas which is directed into this recycle stream is simply that amount necessary to maintain the desired hydrogen pressure and hydrogen-hydrocarbon mol ratio in the first reforming zone. Another portion of the hydrogen-rich gas, normally the remainder thereof, is passed directly to the second reforming zone without being subjected to a compression step. It is thus passed into the second reforming zone at a pressure below the pressure in the first reforming zone. This stream of hydrogen-rich gas supplies the complete hydrogen gas requirement for the reforming operation undertaken in the second reforming zone. Accordingly, there is no recycle of hydrogen-rich gas in the second reforming system, and the hydrogen recycle gas compressor required in previous reforming systems is obviated in the present process.

ILLUSTRATIVE EMBODIMENT

The following description is an example of a preferred embodiment of the process of the present invention. The preferred embodiment is carried out in a system as shown in the attached drawing, described above. In the embodiment, a conventional, hydrotreated petroleum gasoline fraction having a boiling range of 150°–400° F is passed into the fractionator 3 from the conduit 1 at the rate of 30,000 barrels per day (BPD). This wide-boiling fractionator charge is separated into a lower-boiling fraction and a higher-boiling fraction in the fractionators 3 and 11. The lower-boiling fraction, boiling between 150°–220° F, is withdrawn from the fractionator 11 through the conduit 21 at the rate of 7500 BPD for use as a benzene-toluene reforming feed. The higher-boiling fraction, boiling between 220°–400° F, is withdrawn from the fractionator 3 via the conduit 7 at the rate of 22,500 BPD. The higher-boiling hydrocarbon stream is mixed with recycled and compressed hydrogen from the conduit 23 and the resulting liquid-vapor mixture is passed into the reforming zone 25. The higher-boiling stream is reformed at a pressure of 200 psig, an LHSV of 1.5 and a hydrogen-hydrocarbon mol ratio of 6 over a commercially available catalyst containing platinum, rhenium and chloride on an alumina base. The operating temperature is maintained sufficiently high to provide a normally liquid hydrocarbon product having a research octane number of 98. The effluent from the reforming zone 25 is cooled and partially condensed in the cooler 29. The resulting liquid-vapor mixture is charged to the high-pressure separator 33 and flash-separated therein into a product-rich liquid phase and a hydrogen-rich gaseous phase. The product phase is continuously withdrawn from the process through the conduit 35. The hydrogen-rich gaseous phase is removed from the high-pressure separator 33 through the conduit 37 at a pressure below 200 psig and is split into two portions. The first portion is passed into the conduit 39 for recycle to the reforming zone 25. This recycle stream is compressed in the compressor 46 sufficiently to provide the desired 200-psig reforming pressure in the reforming zone 25 and is then passed through the conduit 23 and mixed with the higher-boiling fraction as described above. The remainder of the hydrogen-rich gas is passed from the conduit 37 into the conduit 43 at the rate of 30,000 $ft^3$ of hydrogen per day. This hydrogen-rich gaseous stream is mixed with the lower-boiling fraction, i.e., the benzene-toluene feed, in the conduit 21, and the mixture is passed into the reforming zone 45. The lower-boiling fraction is reformed at a pressure of 100 psig, a LHSV of 1–1.5, and a hydrogen-hydrocarbon mol ratio of 3.5 over the same type of commercial platinum-rhenium catalyst as employed in the reforming zone 25. The operating temperature in the reforming zone 45 is maintained sufficiently high to provide a 90% conversion of methylcyclopentane contained in the feed, with reforming conditions being further selected to maximize production of benzene and toluene. The effluent from the reforming zone 45 is cooled and partially condensed in the cooler 49. The resulting liquid-vapor mixture is then charged to the high-pressure separator 53 and separated into a benzene-toluene product-rich liquid phase and a hydrogen-rich gaseous phase. A product stream of normally liquid hydrocarbons rich in benzene and toluene is continuously withdrawn from the process through the conduit 55, and a low pressure, hydrogen-rich gaseous stream is continuously withdrawn from the process through the conduit 57.

What is claimed is:

1. A process for reforming a first hydrocarbon feedstock and a second hydrocarbon feedstock, which comprises the steps of:

a. contacting said first feedstock and hydrogen with a reforming catalyst in a first reforming zone at reforming conditions including a first reforming pressure;

b. separating a hydrogen-rich gas and a first liquid hydrocarbon product from the effluent from said first reforming zone at a separation pressure below said first reforming pressure;

c. recycling a first portion of said hydrogen-rich gas to provide at least a portion of the hydrogen passed into said first reforming zone;

d. contacting said second feedstock and a second portion of said hydrogen-rich gas with a reforming catalyst in a second reforming zone at reforming conditions including a second reforming pressure lower than said first reforming pressure, with all the hydrogen gas introduced into said second reforming zone being provided solely from said hydrogen-rich gas; and e. recovering a second hydrocarbon product from the effluent from said second reforming zone.

2. A process according to claim 1 wherein said catalyst in said first reforming zone comprises a platinum group metal component, a rhenium component, a halogen component and a porous carrier material.

3. A process according to claim 1 wherein said catalyst in said second reforming zone comprises a platinum group metal component, a rhenium component, a halogen component and a porous carrier material.

4. A process according to claim 1 wherein said first reforming pressure is at least 50 psi above said second reforming pressure.

5. A process for reforming a naphtha feedstock which comprises the steps of:

a. separating said feedstock into a higher-boiling fraction and a lower-boiling fraction;

b. contacting said higher-boiling fraction and hydrogen with a reforming catalyst in a first reforming zone at reforming conditions including a pressure above 175 psig;

c. recovering a hydrogen-rich gas and a first hydrocarbon product from the effluent from said first reforming zone;

d. recycling a first portion of said hydrogen-rich gas stream to provide substantially all the hydrogen passed into said first reforming zone;

e. contacting said lower-boiling fraction and a second portion of said hydrogen-rich gas with a reforming catalyst in a second reforming zone at reforming conditions including a pressure below 175 psi, with all the hydrogen introduced into said second reforming zone being provided solely from said second portion of said hydrogen-rich gas; and f. recovering a second hydrocarbon product from the effluent from said second reforming zone.

6. A process according to claim 5 wherein said catalyst in said first reforming zone comprises a platinum group metal component, a rhenium component, a halogen component and a porous carrier material.

7. A process according to claim 5 wherein said catalyst in said second reforming zone comprises a platinum group metal component, a rhenium component, a halogen component and a porous carrier material.

8. A process according to claim 5 wherein said first reforming pressure is at least 50 psi above said second reforming pressure.

9. A process according to claim 5 wherein the pressure in said first reforming zone is between about 175 psig and about 500 psig and the pressure in said second reforming zone is between about 75 psig and about 150 psig.

* * * * *